US005673654A

United States Patent [19]

Jensen et al.

[11] Patent Number: 5,673,654

[45] Date of Patent: Oct. 7, 1997

[54] MARINE BOILER

[75] Inventors: Mogens Vinzentz Jensen, Vestbjerg; Bodil Mosekær Nielsen, Aalborg Oe; Olav Knudsen, Noerresundby, all of Denmark

[73] Assignee: Aalborg Marine Boilers A/S, Aalborg, Denmark

[21] Appl. No.: 479,033

[22] Filed: Jun. 7, 1995

[30] Foreign Application Priority Data

Jun. 30, 1994 [DK] Denmark ..... 782/94

[51] Int. Cl.[6] ..... F22B 15/00

[52] U.S. Cl. ..... 122/235.11; 122/235.12; 122/235.23; 122/338

[58] Field of Search ..... 122/235.11, 235.12, 122/235.14, 235.15, 235.23, 235.31, 332, 333, 338, 341, 342

[56] References Cited

U.S. PATENT DOCUMENTS

| | | | |
|---|---|---|---|
| 3,118,431 | 1/1964 | Banker et al. | 122/333 |
| 3,633,550 | 1/1972 | Kraus | 122/235.11 |
| 4,257,358 | 3/1981 | Watanabe et al. | 122/235.11 |
| 4,825,813 | 5/1989 | Yoshinara et al. | 122/6 A |
| 4,910,848 | 3/1990 | Spada et al. | 29/890.051 |

FOREIGN PATENT DOCUMENTS

| | | |
|---|---|---|
| 0 052 939 | 6/1982 | European Pat. Off. . |
| 1 390 915 | 1/1965 | France . |
| 1 463 123 | 11/1966 | France . |
| 2 385 981 | 10/1978 | France . |
| 549 353 | 5/1932 | Germany . |
| 308 771 | 11/1972 | Germany . |
| 2 238 223 | 2/1974 | Germany . |
| 2-75805 | 3/1990 | Japan . |
| 351281 | 11/1972 | Sweden . |
| 1 228 459 | 4/1971 | United Kingdom . |

*Primary Examiner*—Noah P. Kamen
*Attorney, Agent, or Firm*—Keck, Mahin & Cate

[57] ABSTRACT

Boiler for generating steam and comprising a furnace wall defining a furnace, a casing wall concentrically encircling the furnace wall and jointly with the furnace wall defining a substantially annular interspace, steam consucting tubes positioned at the furnace wall and the casing wall and being in connection with top and bottom annular vessels and a flue gas aperture in the furnace wall for establishment of connection from the furnace to the annular interspace. At least one of the two walls, i.e. the furnace wall and the casing wall, and perferably both of the walls, i.e. the furnace wall as well as the casing wall, is constituted by steam generating tubes connected by intermediate flanges. Thus, a boiler is provided which is more stable than the prior art boilers and which is not limited to a certain maximum length, but may be provided in any length or size for obtaining the desired effect. In addition, the boiler shows other advantages in comparison with prior art boilers as e.g. a higher reliability, a compact embodiment, a leight weight and a high reliability in operation, and it requires only small space and is easy to install and to maintain.

9 Claims, 2 Drawing Sheets

MARINE BOILER

BACKGROUND OF THE INVENTION

1. Field of the Invention

The present invention relates to a boiler for generating steam and comprising a furnace wall defining a furnace, a casing wall encircling the furnace wall and defining together with the casing wall a substantially annular interspace, steam generating tubes arranged at the furnace wall and the casing wall and being in connection with substantially annular or cylindrical top and bottom vessels and a flue gas opening in the furnace wall for establishing a connection from the furnace to the above mentioned substantially annular interspace.

2. Description of Related Art

A boiler comprises a furnace and a heat exchange area in which the flue gasses give off heat to water for the generating of steam. The walls of the furnace have to be cooled, and therefore they are also utilized appropriately for the heat exchange.

The prior art is described i.a. in AT patent No. 308,771, DE patent No. 549,353, German published patent application No. 2,248,223, published European patent application No. 0 052 939, FR patent No. 1,390,915, FR patent No. 1,463,123, FR patent No. 2,385,981, GB patent No. 1,228,459, SE patent No. 351,281, U.S. Pat. No. 3,118,431, U.S. Pat. No. 3,601,098, U.S. Pat. No. 3,633,550, U.S. Pat. No. 4,257,358, U.S. Pat. No. 4,825,813, U.S. Pat. No. 4,910,848, and "Patent Abstracts of Japan", Vol. 14, nr. 266, M-982, abstract of JP, A, 2-75805 (MIURA CO LTD), to which reference is made, and which patents and publications are hereby incorporated in the present specification by reference.

It is known to provide boilers with a generally cylindrical furnace consisting of vertical tubes and a casing wall, also consisting of vertical tubes, in which a heat exchange area is arranged in the barrel shell between the furnace wall and the casing wall. In one prior art construction, the barrel wall is built up around the furnace by water conducting tubes placed closely together in order to constitute a generally gas tight wall. In a certain distance outside the furnace wall, a casing wall is arranged which is built up by tubes placed in a spaced apart relationship, the tubes being connected by welded narrow flanges so that an adjoining membrane wall is formed. In the heat exchange vessel which is constituted by the substantially annular vessel between the furnace wall and the casing wall, a suitable number of stand-alone tubes may be provided. The flue gasses from the furnace are let out in the barrel shaped vessel through appropriate apertures and circulate therein so that they can release their heat to the steam generating tubes. The end faces of the cylinder are constituted by water tanks which function as collecting boxes for the tubes which are all extending axiparallelly.

Constructions of this nature are rather complicated to build and they suffer from a number of disadvantages. The furnace wall may be hard to make completely gas tight and therefore there is a risk that a part of the heated gasses will escape through other channels than intended. The heat exchange areas of the boiler are difficult to inspect and to clean as the tubes stand tightly in circular patterns concentrically with the cylinder axis. The mounting of the tubes of the furnace wall in the water tanks by the end faces is not simple when the tubes are positioned so closely that they get into contact with one another. A set of holes corresponding to the tubes may not be allowed in the water tank and the tube ends therefore have to have reduced dimensions or special collecting tubes have to be provided.

The exterior panel wall is established by welding narrow flange pieces between the tubes after they have been placed with their ends mounted in the respective water tanks. However, the welding operation is rather complicated because the tubes are likely to be distorted during the welding. These difficulties make it uneconomic to arrange a corresponding interior panel wall around the furnace. While the tubes in the exterior panel wall are welded together, the tubes in the furnace wall and in the interspace between the furnace wall and the panel wall in the prior art construction stand without having a support between their ends. The missing support may cause problems, especially in cases where the boiler is exposed to vibrations as e.g. when mounted in ships. This involves limitations with regard to the possible length of the tubes according to the prior art construction. The limited length causes a defined area of heat surface to require a larger number of tubes than would otherwise be needed. Moreover, the limited length reduces the effect to which the boiler can appropriately be built because the furnace must have a certain free length dependent on the effect in order for the flames to acquire the optimum shape so that a total combustion can take place.

SUMMARY OF THE INVENTION

It is the object of the present invention to provide a boiler of the type described above which does not suffer from the disadvantages of the above described prior art. In particular, it is the object of the present invention to provide a boiler which is more stable than the boilers already known and which is not limited to a certain maximum length, but may be established in any length or size for obtaining a desired effect. It is a further object of the invention to provide a boiler exhibiting further advantages in comparison with the prior art boilers as e.g. in relation to high reliability, a compact form, a low weight and a high reliability in operation and requiring only a limited space and being easy to install and maintain.

These objects are obtained by means of a boiler according to the present invention and comprising a furnace wall defining a furnace, a casing wall concentrically encircling the furnace wall and jointly with the furnace wall defining a substantially annular interspace, top and bottom vessels positioned at the top and bottom, respectively, of the furnace, steam generating tubes arranged at the furnace wall and at the casing wall and being in connection with the top and bottom vessels, and a flue gas aperture provided in the furnace wall for establishing a connection from the furnace to the annular interspace, the furnace wall and/or the casing wall being constituted by substantially straight line steam generating tubes connected by intermediate flanges.

By producing the casing wall and/or the furnace wall of the boiler as described above, i.e. by making the casing wall and/or the furnace wall from substantially straight line steam conducting tubes which are connected by intermediate flanges, a boiler construction is obtained in which the wall or the walls are made from steam generating tubes which are connected by intermediate flanges and exhibit excellent mechanical strength and stability due to the support provided for the wall in question. Thus, the above described limitations and disadvantages of the prior art technique are eliminated as, especially by means of the characteristic features of the boiler according to the present invention, it becomes possible to overcome the limitation in relation to the length of the tubes of the prior art boiler constructions.

The substantially straight line steam generating tubes of the furnace wall and/or the casing wall of the boiler according to the present invention may be connected to the intermediate flanges in any known manner, preferably by welding, but also other joining techniques may be used in special cases, as e.g. fixation in eyelets, press fits, etc.

According to the present invention the boiler is preferably built with a double membrane wall so that the above mentioned furnace wall as well as the above mentioned casing wall are provided as membrane walls, i.e. walls consisting of substantially straight line steam generating tubes extending axially which are connected by means of a welded flange. The interspace between the membrane walls are utilized as a heat exchange area, the hot flue gasses from the furnace passing out in the substantially annular interspace through an aperture in the wall of the furnace, i.e. the furnace wall, and circulating in the intermediate vessel in which the flue gasses can exchange heat partly with the substantially straight line steam generating tubes of the two membrane walls, partly with a number of further, free standing steam generating tubes which may be arranged in the interspace between the casing wall and the furnace wall.

According to the present invention, the membrane walls are built as polygonal plates consisting of a number of plane parts. Each of the plane parts comprises a prefabricated panel wall consisting of a number of longitudinal tubes, e.g. 5–8, connected by intermediate flanges (membranes). Panel walls of this type may be produced under well controlled conditions in an effective sequence of operations and at a very exact result. Depending on the size of the final boiler, the membrane wall may have 9–14 sides, the inner and the outer membrane walls being similar so that the interspace between them is of a constant width. In advance, the panel walls may be provided with one or more plates which project in the transverse direction and which serve as support of the free standing tubes in the interspace between the two panel walls.

These support plates have suitable transit holes through which the free standing tubes may be introduced. The free standing tubes in the interspaces between the membrane walls are arranged in series parallelly to the respective polygonal walls. Inspection of the tubes, e.g. in order to locate any leakages, and soot blowing in order to clean out the soot may be performed anywhere in the heat exchange vessel from a limited number of apertures. An outlet box and an inspection door may be utilized for this purpose at the adjacent polygon sides and a number of special inspection apertures may be arranged, the apertures just being of a size enabling the insertion of a soot blower, a periscope or the like. The special inspection apertures need only be arranged at each second polygon edge at the places with no other possibilities of access. The free standing tubes are arranged in such a manner that a suitable interspace is provided outside the inspection apertures so that inspection of all the tube interspaces is possible.

The polygonal construction provides the final boiler with an excellent mechanical strength and this feature in combination with the support of the tubes in the interspaces causes the ability of the boiler to be built with a relatively large building length without giving rise to vibration problems. Moreover, the polygonal membrane wall provides a gas tight construction. The use of polygonal membrane walls as a furnace wall and a casing wall has the effect that the free standing convection tubes may be arranged in parallel, straight lines. This provides the essential advantage that the free standing tubes may all be inspected and cleaned from apertures in the corners of the casing walls. The construction of the furnace wall in the form of a continuous membrane wall provides the tubes with a very good support so that they are more protected against vibration and pressure influences. The interior membrane wall contains fewer tubes than a corresponding furnace wall built up by closely positioned tubes and therefore it is easier and more simple to mount. The membrane walls and the polygonal construction moreover make it relatively simple to establish the various necessary apertures and connections.

The boiler according to the present invention is provided with a burner which may e.g. be positioned at the top, at the center or at the bottom of the boiler.

The boiler according to the present invention may be used in connection with other types of exhaust gas fired boilers or economizers.

The boiler according to the present invention may be used as a supplementary boiler for producing steam for a number of purposes such as e.g. in connection with heating, discharge, cleaning, production of inert gas and the like.

In addition, the boiler according to the present invention may be used in connection with e.g. power stations, industrial plants, tankers, chemical carriers, ferries or the like.

BRIEF DESCRIPTION OF THE DRAWINGS

A preferred embodiment of the present invention will be described below with reference to the drawing in which.

DESCRIPTION OF THE PREFERRED EMBODIMENT

Figure 2:
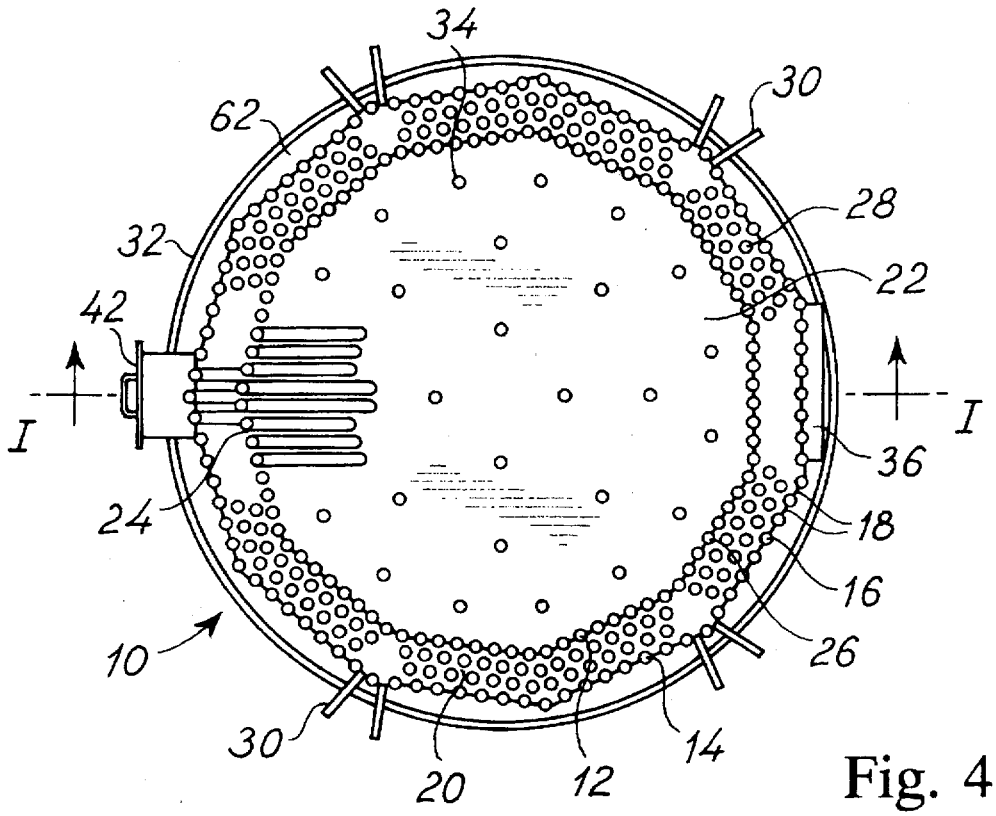
FIG. 2 is a sectional and perspective top view along the line II—II of a boiler in FIG. 1.

FIG. 2 illustrates a boiler 10 comprising a furnace wall 12 defining a furnace 22, a casing wall 14 encircling the furnace wall 12 and together with the furnace wall constituting a substantially annular interspace 20. The furnace wall 12 comprises axially extending tubes 26 connected by flanges 18 which wall 12 comprises an aperture 24 for establishment of connection from the furnace 22 to the annular interspace 20. The casing wall 14 comprises axially extending tubes 16 connected by flanges 18 in which wall 14 a suitable number of inspection apertures 30 are positioned. The furnace wall and the casing wall are built up as polygonal plates constituting a number of plane parts comprising a prefabricated panel wall constituting a number of longitudinal tubes 16, 26 connected to intermediate flanges 18. In the interspace 20, free standing steam generating tubes 28 are mounted which are arranged in straight lines running parallelly with the respective polygonal walls. A lower annular wall 32 encircles an annular bottom vessel 62 in which bottom support members 34 are positioned. In connection with the casing wall 14 a flue gas outlet 36 is provided. At the bottom of the boiler 10 an access aperture 42 is provided for inspection purposes.

Figure 1:
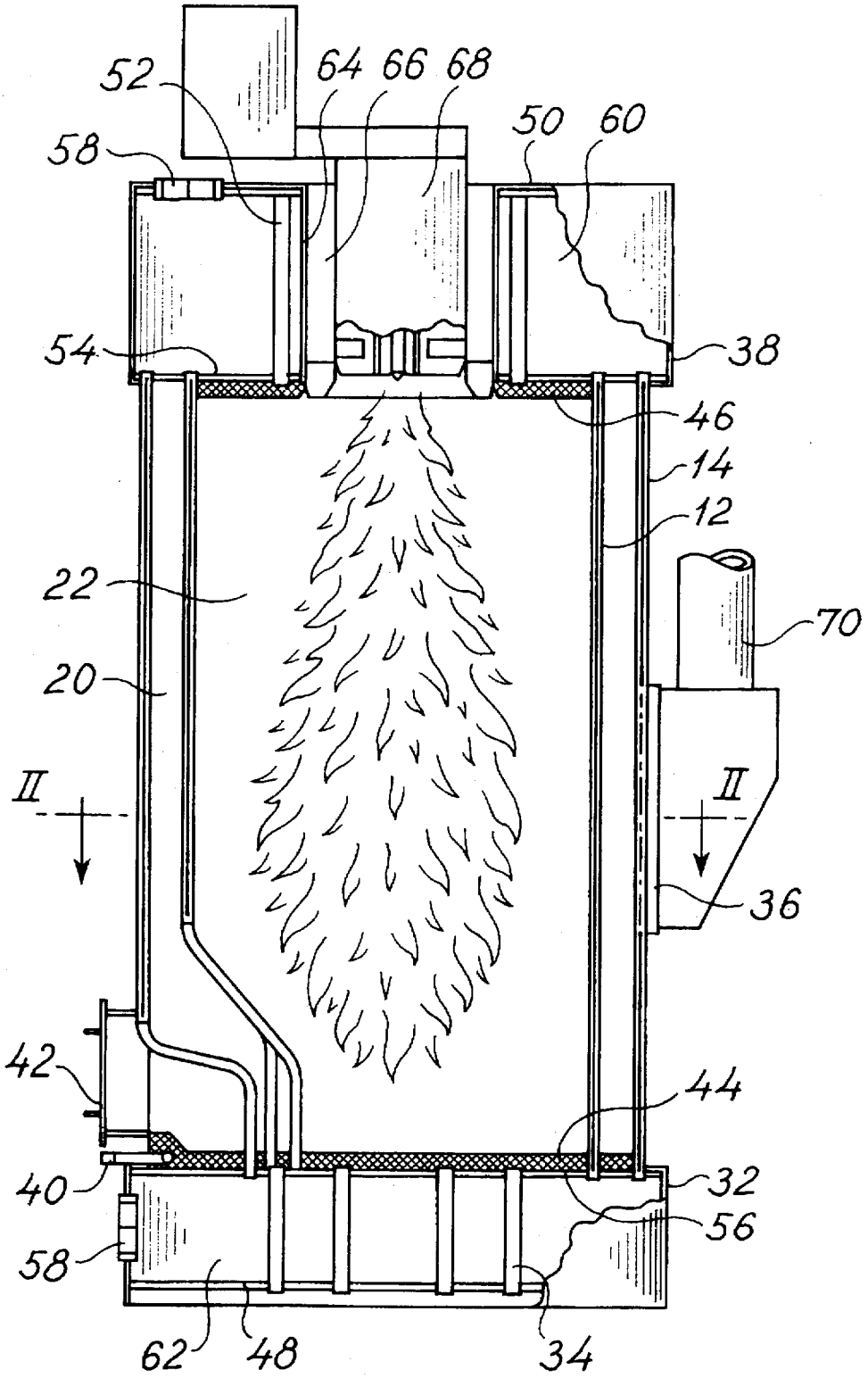
FIG. 1 is a sectional view along the line I—I of the boiler in FIG. 2.

FIG. 1 illustrates the boiler 10 comprising the furnace wall 12 defining the furnace 22, the casing wall 14 concentrically encircling the furnace wall 12 and jointly with the furnace wall constituting the substantially annular interspace 20. The furnace wall and the casing wall are connected with annular top and bottom vessels 60, 62. The annular bottom vessel 62 comprises a bottom plate 48 which through bottom support members 34 are connected to a bottom tube plate 56, and an annular wall 32 in which a manhole 58 is positioned.

A resistant material 44 is provided in connection with the bottom tube plate 56. The annular top vessel 60 comprises a top plate 50 in which a manhole 58 is provided which top plate is connected through support members 52 to a top tube plate 54 which vessel 60 is defined by a casing wall 38 and a furnace wall 64. In the annular top vessel 60, an aperture for a burner 68 is arranged which aperture is encircled by the furnace wall 64. In connection with the flue gas outlet 36, a flue gas duct 70 is provided. In the bottom part of the boiler 10, a drainage tube is provided.

Figure 3:
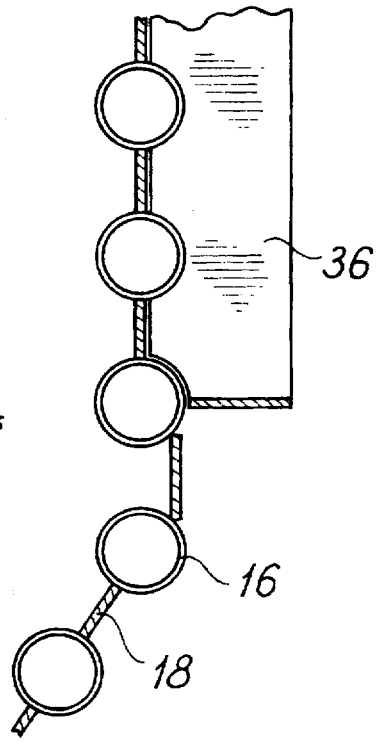
FIG. 3 is a view of a part of a casing wall.

FIG. 3 illustrates a part of the end of the casing wall 14 in FIG. 2 comprising axially extending tubes 16 connected by intermediate flanges 18 and comprising inspection apertures 30 arranged in the flanges 18.

Figure 4:
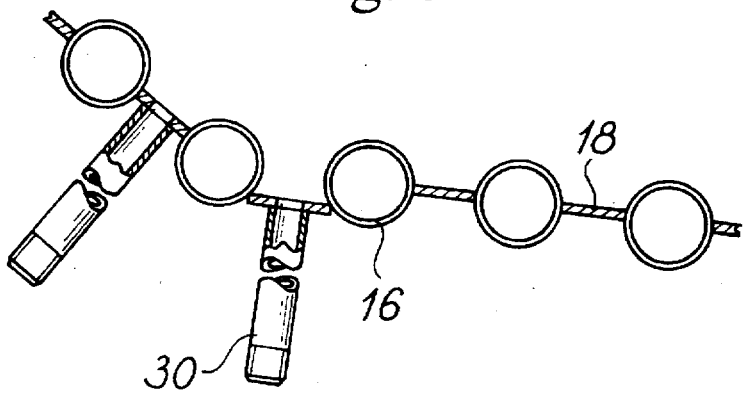
FIG. 4 is a view of a part of a casing wall and a flue gas exit.

FIG. 4 illustrates a part of the casing wall 14 and the flue gas outlet 36 in FIG. 2.

Although the invention has been described above with reference to the drawings illustrating a presently preferred embodiment of the invention, it is evident for people skilled in the art that numerous modifications compared to the above described embodiment may be made within the scope of the present invention. Such modifications are covered by the protective scope of the present invention as defined in the following patent claims.

EXAMPLE

Alternative embodiments of the boiler according to the present invention and provided as described above with reference to FIGS. 1–4 were produced and tested.

The boilers were provided with a top mounted burner of the KBSA type.

The boilers were tested and the results are evident from the below Tables 1 and 2.

TABLE 1

| Steam output kg/t | Standard design pressure barg | Oil fuel consumption kg/t | Thermal output at 100% MCR. Max. load % | Thermal output at 100 MCR kW | Height "H" mm | Height "K" incl. retraction of burner lance mm | Diameter "D" mm | Weight of empty boiler t | Operation weight of boiler t | Flue gas stream kg/t | Flue gas outlet temp. Max/min load °C. |
|---|---|---|---|---|---|---|---|---|---|---|---|
| 6,300 | 10 | 480 | 84 | 4,400 | 5,450 | 7,450 | 1,950 | 10.8 | 14.7 | 7,500 | 390/250 |
| 8,000 | 10 | 600 | 84 | 5,600 | 5,600 | 7,600 | 2,100 | 11.7 | 16.3 | 9,400 | 390/250 |
| 10,000 | 10 | 750 | 84 | 7,000 | 5,750 | 7,750 | 2,250 | 13.0 | 18.5 | 11,800 | 390/250 |
| 12,000 | 10 | 900 | 84 | 8,400 | 5,700 | 7,700 | 2,400 | 14.0 | 20.2 | 14,100 | 390/250 |
| 14,000 | 10 | 1,050 | 84 | 9,800 | 6,500 | 8,500 | 2,400 | 15.9 | 22.4 | 16,500 | 390/250 |
| 16,000 | 18 | 1,210 | 84 | 11,300 | 6,650 | 8,650 | 2,600 | 21.6 | 28.9 | 19,000 | 390/250 |
| 20,000 | 18 | 1,510 | 84 | 14,100 | 6,300 | 8,300 | 3,050 | 27.9 | 37.9 | 23,700 | 390/250 |
| 25,000 | 18 | 1,890 | 84 | 17,600 | 7,300 | 9,300 | 3,050 | 30.1 | 40.7 | 29,600 | 390/250 |
| 30,000 | 18 | 2,260 | 84 | 21,100 | 7,400 | 9,400 | 3,300 | 33.4 | 45.8 | 35,600 | 390/250 |
| 35,000 | 18 | 2,640 | 84 | 24,700 | 7,700 | 9,700 | 3,550 | 37.5 | 52.1 | 41,500 | 390/250 |
| 40,000 | 18 | 3,020 | 84 | 28,200 | 7,750 | 9,750 | 3,700 | 40.8 | 57.1 | 47,500 | 390/250 |
| 45,000 | 18 | 3,390 | 84 | 31,700 | 7,900 | 9,900 | 3,900 | 44.8 | 63.1 | 53,400 | 390/250 |

Output data based on: Excess air relationship 1.10. Oil fuel net ca. value 40,200 kJ/kg. Feed water temp. 60° C. Air temp. 27° C.

TABLE 2

Standard product range AQ-18 two drum oil fired boiler:

| Steam production/ Capacity Kg/t | Max. allowable working pressure barg | Fuel oil consumption kg/h | Thermal efficiency at 100% MCR. Max. load % | Thermal output at 100% MCR kW | Height "H" mm | Height "K" incl. retraction of burner lance mm | Diameter "D" mm | Weight of empty boiler t | Duty weight of boiler t | Flue gas flow kg/h | Flue gas outlet temp. Max./Min. load degr. C |
|---|---|---|---|---|---|---|---|---|---|---|---|
| 6,310 | 9 | 450 | 84 | 4,200 | 5,450 | 7,400 | 1,950 | 10.3 | 14.2 | 7,200 | 370/200 |
| 8,000 | 9 | 560 | 84 | 5,300 | 5,600 | 7,600 | 2,150 | 11.4 | 16.1 | 9,100 | 360/220 |
| 10,000 | 9 | 700 | 84 | 6,700 | 5,750 | 7,700 | 2,250 | 12.7 | 18.1 | 11,400 | 360/220 |
| 12,000 | 9 | 850 | 84 | 8,000 | 5,700 | 7,700 | 2,400 | 13.8 | 20.0 | 13,700 | 370/230 |
| 14,000 | 9 | 990 | 84 | 9,300 | 6,500 | 8,500 | 2,400 | 15.5 | 22.0 | 16,000 | 370/230 |
| 16,000 | 18 | 1,140 | 84 | 10,700 | 6,300 | 8,300 | 2,800 | 23.1 | 32.4 | 18,400 | 370/240 |
| 20,000 | 18 | 1,430 | 84 | 13,400 | 6,300 | 8,300 | 3,050 | 26.9 | 37.9 | 23,200 | 380/240 |
| 25,000 | 18 | 1,780 | 84 | 16,800 | 7,350 | 9,500 | 3,050 | 29.1 | 39.7 | 28,800 | 380/240 |
| 30,000 | 18 | 2,140 | 84 | 20,200 | 7,450 | 9,600 | 3,300 | 32.7 | 45.3 | 34,600 | 380/240 |
| 35,000 | 18 | 2,500 | 84 | 23,500 | 7,750 | 9,900 | 3,550 | 37.2 | 51.9 | 40,500 | 380/240 |
| 40,000 | 18 | 2,870 | 84 | 26,800 | 7,800 | 10,200 | 3,700 | 40.6 | 57.2 | 46,500 | 390/250 |
| 45,000 | 18 | 3,210 | 84 | 30,200 | 7,950 | 10,300 | 3,950 | 45.0 | 63.8 | 52,000 | 390/250 |

Performance data based on: Excess air ratio 1.13. Fuel oil net calorific value 40,200 kJ/kg. Feed water temperature 90 degr. C. Air temperature 27 degr. C.
Dimension table: Approximate dimensions only, excl. insulation and mountings.
Other capacities and sizes are available upon request.

We claim:

1. A boiler generating steam comprising:

a furnace wall defining a furnace, a casing wall concentrically encircling said furnace wall and, jointly with said furnace wall, defining a substantially annular interspace, top and bottom vessels positioned at the top and bottom, respectively, of said furnace, steam generating tubes arranged at said furnace wall and at said casing wall and being in connection with said top and bottom vessels, and a flue gas aperture provided in said furnace wall for establishing a connection from said furnace to said annular interspace, at least one of said furnace wall and said casing wall being formed from substantially straight line steam generating tubes connected by intermediate flanges, wherein at least one of said furnace wall and said casing wall is polygonal and includes a number of planar parts.

2. The boiler according to claim 1, and further comprising free standing steam generating tubes mounted in said interspace.

3. The boiler according to claim 2, wherein said free standing tubes are arranged in substantially straight lines extending parallel with said substantially straight line steam generating tubes.

4. The boiler according to claim 2, wherein each of said planar parts comprises a prefabricated panel wall formed by said tubes connected by said intermediate flanges.

5. The boiler according to claim 4, wherein each of said planar parts includes 5–8 of said tubes.

6. The boiler according to claim 4, wherein said panel wall is provided with at least one plate projecting in a transverse direction and supporting said free standing tubes.

7. The boiler according to claim 1, wherein 9–14 of said planar parts are provided and said interspace has a constant width.

8. The boiler according to claim 1, and further comprising a burner positioned at one of the top, the bottom and the center of said furnace.

9. The boiler according to claim 1, wherein at least one of said top and bottom vessels has one of an annular and a cylindrical configuration.

* * * * *